US011417965B2

(12) United States Patent
Sharawi et al.

(10) Patent No.: US 11,417,965 B2
(45) Date of Patent: Aug. 16, 2022

(54) PLANAR INVERTED F-ANTENNA INTEGRATED WITH GROUND PLANE FREQUENCY AGILE DEFECTED GROUND STRUCTURE

(71) Applicant: King Fahd University of Petroleum and Minerals, Dhahran (SA)

(72) Inventors: Mohammad S. Sharawi, Dhahran (SA); Rifaqat Hussain, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 0 days.

(21) Appl. No.: 15/997,774

(22) Filed: Jun. 5, 2018

(65) Prior Publication Data

US 2019/0372241 A1 Dec. 5, 2019

(51) Int. Cl.
*H01Q 1/24* (2006.01)
*H01Q 21/28* (2006.01)
(Continued)

(52) U.S. Cl.
CPC ..... *H01Q 21/28* (2013.01); *H01Q 1/243* (2013.01); *H01Q 5/321* (2015.01); *H01Q 9/0421* (2013.01); *H01Q 9/0442* (2013.01)

(58) Field of Classification Search
CPC ..... H01Q 21/28; H01Q 5/321; H01Q 9/0421; H01Q 9/0442; H01Q 1/243; H01Q 1/521
See application file for complete search history.

(56) References Cited

U.S. PATENT DOCUMENTS 6,828,942 B2 * 12/2004 Louzir ..... H01Q 1/38 343/767
8,816,921 B2 * 8/2014 Ayatollahi ..... H01Q 1/243 343/702

(Continued)

FOREIGN PATENT DOCUMENTS

JP 2005252480 * 9/2005

OTHER PUBLICATIONS

Hussaun, Rifaqat, et al. ; An Integrated Dual MIMO Antenna System With Dual-Function GND-Plane Frequency-Agile Antenna ; IEEE Antennas and Wireless Proagation Letters, vol. 17, No. 1 ; Jan. 2018 ; 4 pages.

(Continued)

*Primary Examiner* — Awat M Salih
(74) *Attorney, Agent, or Firm* — Oblon, McClelland, Maier & Neustadt, L.L.P.

(57) ABSTRACT

An antenna system, an apparatus, and a method for configuring an antenna system are provided. The antenna system includes a dielectric substrate. The dielectric substrate has a top surface and a bottom surface. The antenna system also includes a first planar inverted-F antenna (PIFA) radiating element and a second PIFA radiating element disposed on the top surface of the dielectric substrate, each of the PIFA radiating elements having a F-head portion. The antenna system also includes at least two defected ground structures (DGSs) disposed on the bottom surface of the dielectric substrate and configured to provide isolation between the first and the second PIFA radiating element. Each DGS includes a varactor diode. The antenna system also includes a bias circuit corresponding to each of the at least two DGSs.

20 Claims, 8 Drawing Sheets

(51) Int. Cl.
*H01Q 9/04* (2006.01)
*H01Q 5/321* (2015.01)

(56) References Cited

U.S. PATENT DOCUMENTS

| | | | | |
|---|---|---|---|---|
| 9,153,874 | B2 | 10/2015 | Ouyang et al. | |
| 9,666,946 | B1 | 5/2017 | Sharawi et al. | |
| 9,698,495 | B2 | 7/2017 | Sharawi et al. | |
| 2016/0336643 | A1 | 11/2016 | Pascolini et al. | |
| 2017/0141465 | A1* | 5/2017 | Sharawi | H01Q 1/48 |
| 2018/0108984 | A1* | 4/2018 | Wu | H01Q 5/371 |

OTHER PUBLICATIONS

Hussain, Rifaqat, et al. ; Annular Slot-based Miniaturized Frequency Agile MIMO Antenna System ; IEEE Antennas and Wireless Propagation Letters vol. 16 ; Sep. 2017 ; 5 Pages.
Joshi, Sudarshan, et al. ; Frequency Agile Triple Band Microstrip Antenna for WLAN/WiMAX Application ; International Journal of Future Computer and Communication, vol. 3, No. 4 ; Aug. 2014 ; 4 pages.
Karimian, Reza, et al. ; Novel F-Shaped Quad-Band Printed Slot Antenna for WLAN and WiMAX MIMO Systems ; IEEE Antennas and Wireless Propagation Letters, vol. 12 ; 2013 ; 4 pages.
Wang, Yu-Shin, et al. ; Two PIFA-Related Miniaturized Dual-Band Antennas ; IEEE Transactions on Antennas and Propagation, vol. 55, No. 3 ; Mar. 2007 ; 7 pages.

* cited by examiner

PLANAR INVERTED F-ANTENNA INTEGRATED WITH GROUND PLANE FREQUENCY AGILE DEFECTED GROUND STRUCTURE

BACKGROUND

Field of the Invention

This invention relates to antenna systems especially configured for wide-band wireless communication, consumer electronic devices, and reconfigurable multiple-input-multiple-output (MIMO) systems.

Background of the Invention

In modern wireless communications, the exponential growth of wireless services results in an increasing data rate requirements and data reliability. Communication services may include high-quality audio/video calls, online video streaming, video conferencing, and online gaming. These demanding services may require wide bandwidth operation or operation across several frequency bands. This requires efficient utilization of the available spectrum via sensing of available unused bands. The concept of cognitive radio (CR) overcomes the inefficient and highly underutilized spectrum resources. A CR system is based on a software defined radio (SDR) structural design and is intended to enhance spectrum utilization efficiency by interacting with the operating environment. CR based systems are aware of the communications environment by sensing spectrum usage and have the capability to switch operating points among different unoccupied frequency bands. CR based systems may include various features such as sensing spectrum of nearby devices, switching between different frequency bands, and power level adjustment of transmitting antennas.

The front end of a CR includes two antennas: (1) an ultra-wide-band (UWB) sensing antenna and (2) a reconfigurable communication antenna. UWB antenna is used to sense the entire spectrum of interest while reconfigurable antennas are used to dynamically change the basic radiating characteristic of the antenna system to utilize the available bandwidth. Frequency reconfigurable multiple-input-multiple-output (MIMO) antenna systems provide potential advantages such as having several frequency bands/multi-band operations, high system throughput and enhancing the data rate capability of MIMO systems. Reconfigurable MIMO antennas are also utilized at the front-ends of cognitive radio (CR) applications. CR is being utilized in communication systems to avoid spectrum congestion by switching the operating bands. Slot-based reconfigurable antennas are highly suitable to be used in CR system because of their low profile structure and ease of integration with other components.

It is therefore an object of the present disclosure to describe an antenna system having PIFA elements that operates at the wireless local area network (WLAN) band and annular slots that act as an isolation enhancement structure for the PIFA elements. The slots are made reconfigurable using varactor diodes by applying reverse bias voltage across their terminals.

The foregoing "Background" description is for the purpose of generally presenting the context of the disclosure. Work of the inventor, to the extent it is described in this background section, as well as aspects of the description which may not otherwise qualify as prior art at the time of filing, are neither expressly or impliedly admitted as prior art against the present invention.

SUMMARY

The present disclosure relates to an antenna system. The antenna system includes a dielectric substrate. The dielectric substrate has a top surface and a bottom surface. The antenna system also includes a first planar inverted-F antenna (PIFA) radiating element and a second PIFA radiating element disposed on the top surface of the dielectric substrate. The PIFA radiating element has a F-head portion. The antenna system also includes at least two defected ground structures (DGSs) disposed on the bottom surface of the dielectric substrate. The at least two DGSs are configured to provide isolation between the first and the second PIFA radiating element. Each DGS antenna includes a varactor diode. The antenna system also includes a bias circuit corresponding to each of the at least two DGSs.

In another aspect, the present disclosure relates to an apparatus. The apparatus includes an antenna system and wireless circuitry that uses the antenna system to handle signals in one or more communication bands. The antenna system includes a dielectric substrate. The dielectric substrate has a top surface and a bottom surface. The antenna system also includes a first planar inverted-F antenna (PIFA) radiating element and a second PIFA radiating element disposed on the top surface of the dielectric substrate. The PIFA radiating element has a F-head portion. The antenna system also includes at least two DGSs disposed on the bottom surface of the dielectric substrate. The at least two DGSs are configured to provide isolation between the first and the second PIFA radiating element. Each DGS antenna includes a varactor diode. The antenna system also includes a bias circuit corresponding to each of the at least two DGSs.

In another aspect, the present disclosure relates to a method for configuring an antenna system. The method includes forming two planer inverted F antennas for operation at a desired frequency at a top surface of a dielectric substrate; forming at least two defected ground structures (DGSs) at a bottom surface of the dielectric substrate to provide isolation between the two PIFA antennas, each of the DGS including a varactor diode to reactively load the DGS; forming a bias circuit for each of the DGS; and controlling, using processing circuitry, a voltage to the varactor diode based on a desired resonant frequency.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
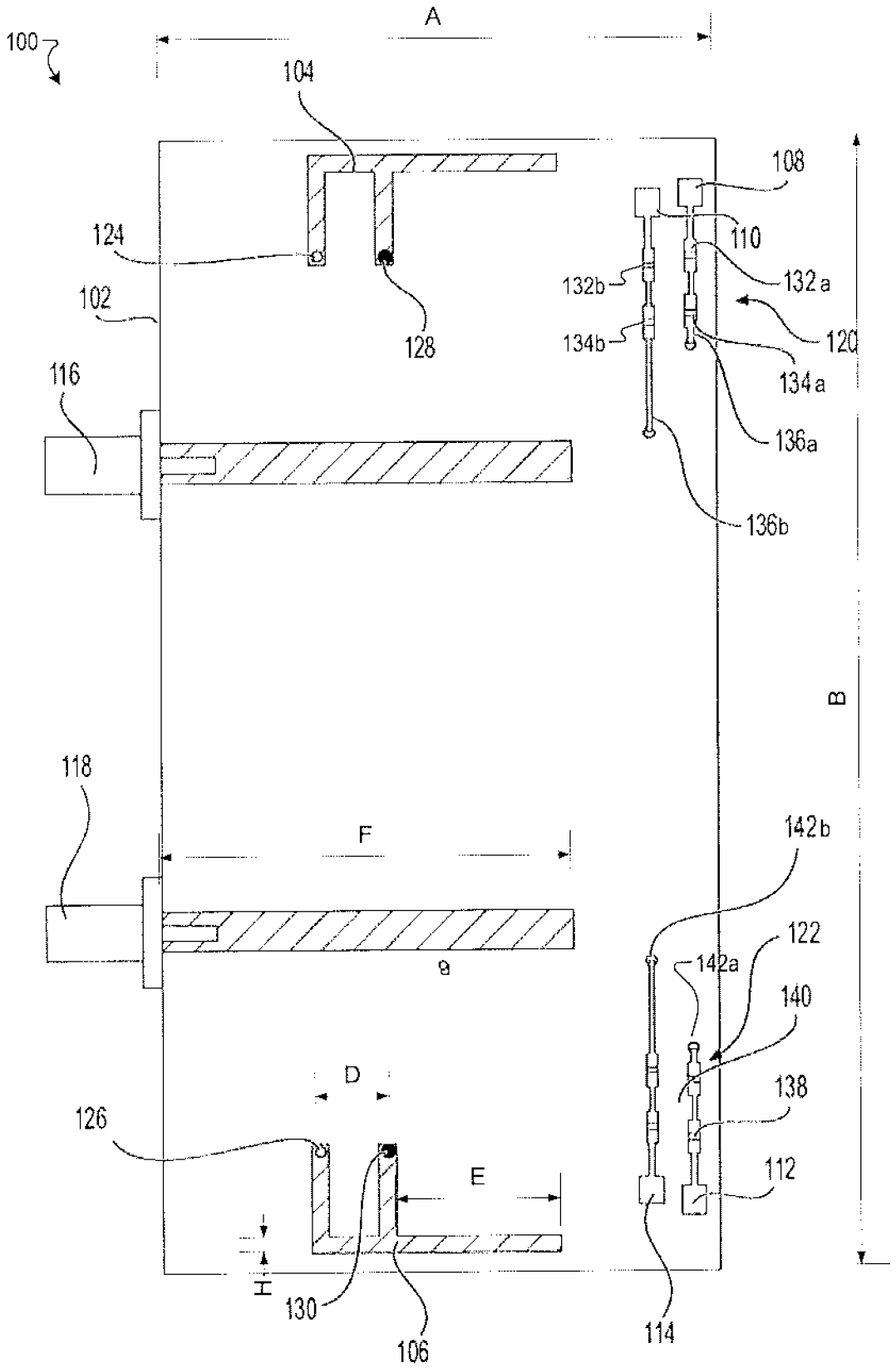
FIG. 1 is a top view of a printed circuit board of an antenna system according to one example.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an embodiment", "an implementation", "an example" or similar terms means that a particular feature, structure, or characteristic described in connection with the embodiment is included in at least one embodiment of the present disclosure. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Referring now to the drawings, wherein like reference numerals designate identical or corresponding parts throughout several views, the following description relates to an integrated multiple-input-multiple-output (MIMO) antenna system.

The MIMO antenna system may be used in the field of wide-band wireless communication systems and consumer electronic devices, reconfigurable multiple-input-multiple-output (MIMO) antenna systems for cognitive radio platform for compact wireless devices, and long-term evolution (LTE) mobile handsets. The complete antenna setup can be used in radio frequency based applications including 4G cellular systems.

An integrated MIMO antenna system is described herein. The antenna includes two planar inverted F-antenna (PIFA) elements integrated with two annular slot based frequency agile antennas to form a dual MIMO antenna system. The isolation is improved between the two PIFA elements as the annular slots acts as a defected ground structure (DGS). The annular slots are utilized as a frequency reconfigurable MIMO antenna system. The dual function frequency reconfigurable MIMO configuration increases the system throughput by increasing the number of antenna elements in wireless handheld devices by reusing DGS structures as separate set of antennas without modifying the board size.

Figure 2:
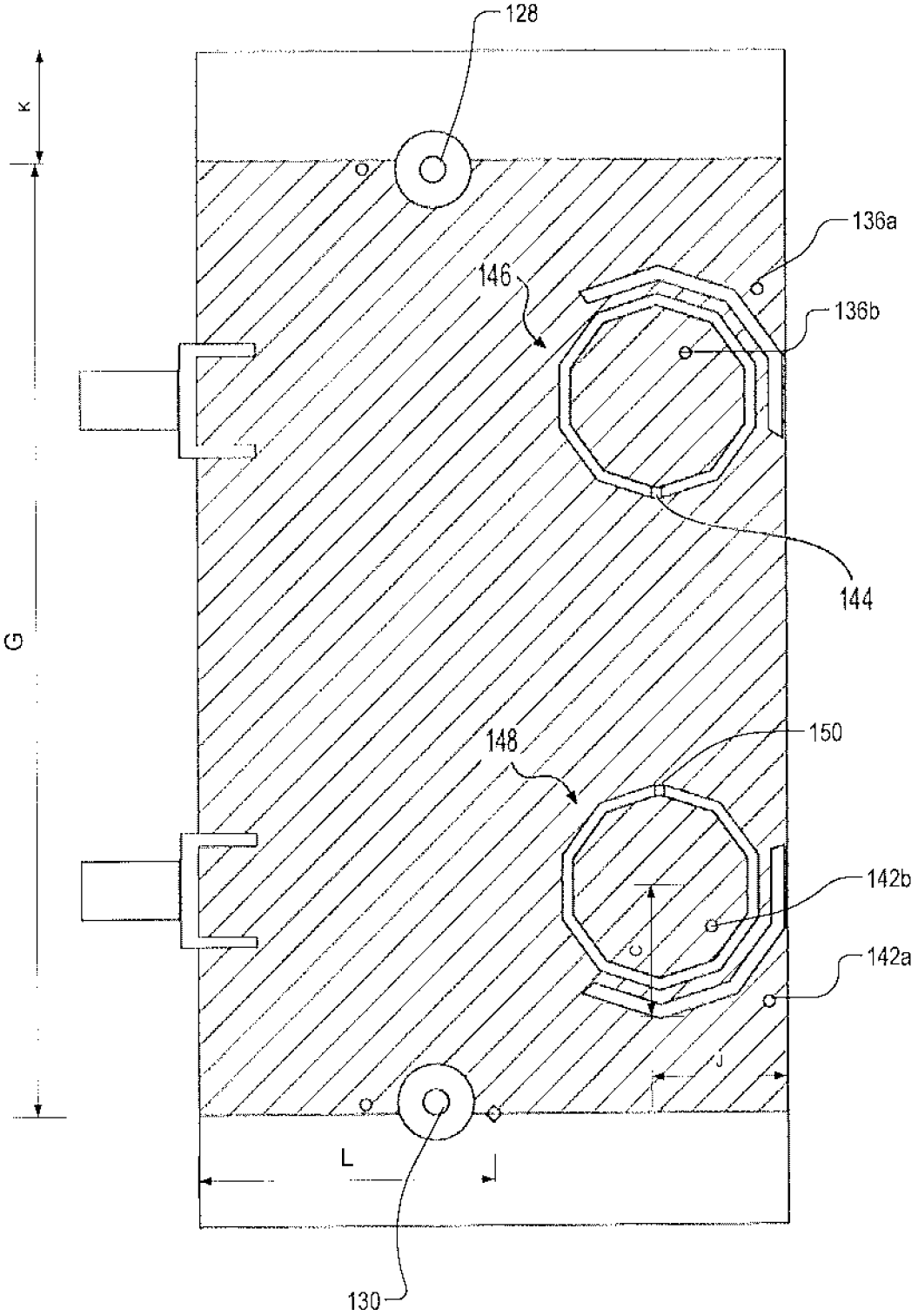
FIG. 2 is a bottom view of the printed circuit board of the antenna system according to one example.

The geometry of the integrated dual MIMO antenna system 100 is shown in FIG. 1 and FIG. 2. The antenna system 100 includes a dielectric substrate 102 (e.g., a printed circuit board). In one implementation, the dielectric substrate 102 may be a commercially available FR-4 substrate having a relative permittivity ($\varepsilon_r$) of 4.4, a loss tangent of 0.02, and a thickness of 1.56 mm. In one implementation, the relative permittivity may be in the range of 4.25 to 4.55. For example, the relative permittivity of the substrate may be 4.25, 4.3, 4.35, 4.4, 4.45, 4.50, or 4.55. The thickness of the substrate may range from 0.127 mm to 3.175 mm. In one implementation, the thickness of the substrate may range from 0.2 mm to 3 mm. In one implementation, the thickness of the substrate may range from 0.4 mm to 2.5 mm. In one implementation, the thickness of the substrate may range from 0.7 mm to 2 mm. In one implementation, the thickness of the substrate may range from 1 mm to 1.75 mm.

FIG. 1 shows the top surface of the antenna system 100 according to one example. The dielectric substrate 102 may be a rectangular dielectric substrate having a short peripheral edge and a long peripheral edge. The antenna system 100 includes two planar radiating or conducting (e.g., copper) inverted F-Antenna (PIFA) elements 104, 106. The PIFA elements 104, 106 are disposed on a top surface of the dielectric substrate 102. In one implementation, each PIFA element is disposed substantially near the edge of the substrate 102. The PIFA elements 104, 106 may be disposed near the short peripheral edge of the substrate 102. Each PIFA element is formed by two arms extending to a long peripheral edge of the dielectric substrate. The F-tail portion of the PIFA extends from a short peripheral edge of the rectangular substrate (edge having dimension A). The first PIFA element 104 and the second PIFA element 106 are mirror images of each other. In one implementation, the rectangular dielectric substrate may have dimensions A×B: $50\times110$ mm$^2$.

The top layer also includes microstrip feed-lines 116, 118 for annular slot-based antennas 146, 148, and biasing circuitry 120,122, for varactor diodes 144, 155.

FIG. 2 shows the bottom surface of the printed circuit board of the antenna system 100 according to one example. The bottom surface includes the two annular slot-based antennas 146, 148 and the probe-feed connectors 128, 130 to feed the PIFA elements 104, 106. The annular slot antennas 146, 148 are etched out from the ground (GND) plane. The probe feed connectors 128, 130 may be SMA connectors (SubMinuature version A). The annular slots 146, 148 are deposited toward the substrate edge to maintain GND continuity and integrity. A first varactor diode 144 is placed on the annular slot antenna 146. A second varactor diode 150 is placed on the annular slot antenna 148. The varactor diodes 144, 150 may be used to reactively load the antenna.

The PIFA antenna elements 104, 106 are fed with 50Ω probe-feed connectors 128, 130. In one implementation, the antenna dimensions are set for resonance at 2.45 GHz. The antenna dimensions may be set for resonance at a frequency in the range of 2.295 to 2.68 GHz. A considerable mutual coupling value is observed between the two PIFA antenna elements. In order to enhance the isolation, the set of two annular slots 146, 148 are created between them. The dimensions and location of the slots are optimized to improve the isolation between the PIFA antenna elements at 2.45 GHz. The antenna dimensions may be optimized to resonate at other frequencies as would be understood by one of ordinary skill in the art.

Open-end microstrip transmission-lines 116,118 with 500 characteristic impedance are used to feed the annular slots 146, 148. The DGS structure (i.e., annual slot antennas 146, 148) is utilized as a frequency reconfigurable antenna. In one implementation, an electrical length of $\lambda/2$ corresponds to resonance at 3.1 GHz where $\lambda$ is the wavelength. The antenna dimensions of the slot are optimized such as the antenna resonates at 3.1 GHz without any reactive loading. The antenna dimensions of the slot may be set such as the antenna resonates at a frequency in the range of 2.9 GHz to 3.3 GHz. In one implementation, the frequency may be in the range of 2.5 GHz to 4 GHz.

The slot antennas 146, 148 may include reactive elements. The slot antennas 146, 148 including reactive element are frequency reconfigurable. Parametric sweeps may be performed to properly place the reactive elements (e.g., varactor diodes) and to effectively load the slot antenna. The current positions of the varactor diodes as shown in FIG. 2 had maximal effect on the antenna resonance. The terminals of the first varactor diode 144 are connected to the biasing circuit 120 using two shorting pins (sp)/vias 136*a*, 136*b* as shown in FIG. 1. The terminals of the second varactor diode 150 are connected to the biasing circuit 122 using two shorting pins (sp)/vias 142*a*, 142*b*. Each varactor diode may be mounted on the two edges of the slot antenna and soldered across it. In one implementation, the radius and width of the annular slot are 8.65 mm and 0.5 mm, respectively while the radius of the outer semi-circular slot is 11 mm (indicated by C in FIG. 2).

In one implementation, the antenna system 100 may include additional varactor diodes to provide more flexibility to tune the antenna over a wide band as would be understood by one of ordinary skill in the art.

Figure 3:
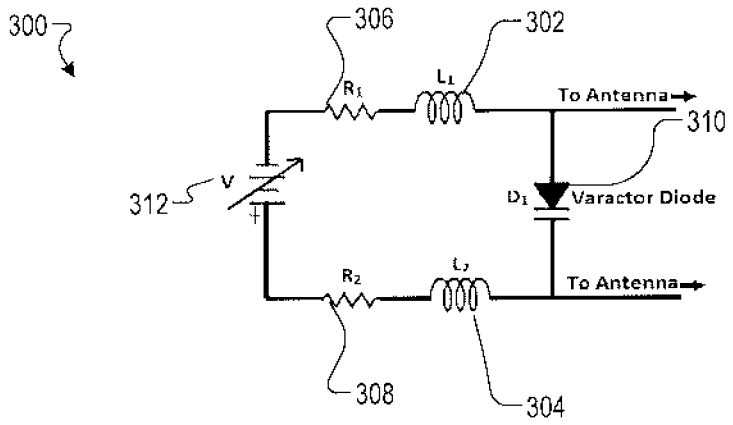
FIG. 3 is a schematic diagram of bias circuits of radiating elements of the antenna system according to one example.

FIG. 3 is a schematic diagram of a bias circuit for a radiating element of the antenna system 100 according to one example. The biasing circuit 300 includes a first series combination of a first radio frequency (RF) choke 302 and a first resistor 306, and a second series combination including a second RF choke 304 and a second resistor 308 connected to the two terminals of the varactor diode 310. In one implementation, the first RF choke and the second RF choke 304 may have a value of 1 μH. The first resistor 306 and the second resistor may have a value of 2.1 kΩ. The first and second series combinations are connected to a variable voltage source 312. In one implementation, the first resistor 306 and the second resistor 308 may be implemented using a combination of series and/or parallel resistors having an equivalent resistance of 2.1 kΩ. In one implementation, the equivalent resistance may be in the range of 1.75 kΩ to 2.5 kΩ.

A biasing circuit similar to biasing circuit 300 may be used to bias each of the varactor diodes of the antenna system 100. The biasing circuit 120 associated with the first varactor diode 144 includes resistors 132*a*, 132*b* and RF chokes 134*a*, 134*b*. The varactor diode 144 is reverse biased by applying a variable voltage source (not shown) between a positive terminal 108 and GND pad 110. The biasing circuit 122 associated with the second varactor diode 150 includes resistors 138*a*, 138*b* and RF chokes 140*a*, 140*b*. The varactor diode 144 is reverse biased by applying a variable voltage source between a positive terminal 112 and GND pad 114.

The varactor diode is utilized to tune the resonance frequency of the annular slot antenna over a wide operation band. In one implementation, the varactor diode may be a SMV 1235 varactor diode. The varactor diode package may be 0805 with standard dimensions of 2.0 mm×1.2 mm. Other varactor diode packages may be used as would be understood by one of ordinary skill in the art. In one implementation, the varactor diode package may have dimensions in the range of about 1.5 mm to 2.5 mm by about 0.8 mm to about 1.5 mm.

In one implementation, the bias circuit may be tuned using control signals from control circuitry or a controller. The controller may be associated with an electronic device including the antenna system 100. Control signals may be provided to adjust the variable voltage source 312 and therefore the capacitance. By selecting a desired capacitance value using the control signals, the radiating element can be tuned to cover operating frequencies of interest.

In one implementation, the PIFA elements 104, 106 may have the following dimensions: D=7.4 mm, E=4.4 mm, and H=3.48 mm. A length of the micorstrip feed-line 118 may be 36 mm (indicated by F in FIG. 1). The center of the annular slot antenna 148, 146 may be 13.84 mm from the long edge of the substrate (indicated by J in FIG. 2). The bottom surface of the PCB includes two substrates regions having a width of 15 mm (indicated by K in FIG. 2) and a copper region having a length of 80 mm (indicated by G in FIG. 2). The head of the PIFA element may be at 29.64 mm from the long edge of the substrate (indicated by L in FIG. 2). The board height may be 1.56 mm and dielectric constant of the substrate is $(\varepsilon_r)$=4.4. The dimensions of the elements are exemplary. The antenna elements may be tuned and their dimensions changed based on the application and associated frequency bands.

To illustrate the capabilities of the antenna system described herein, exemplary results are presented.

A professional software high frequency structural simulator (HFSS™) is used to observe the reflection response and the radiation properties of the antenna system. A prototype of the antenna system described herein is fabricated using a LPKF S103 machine.

Figure 4:
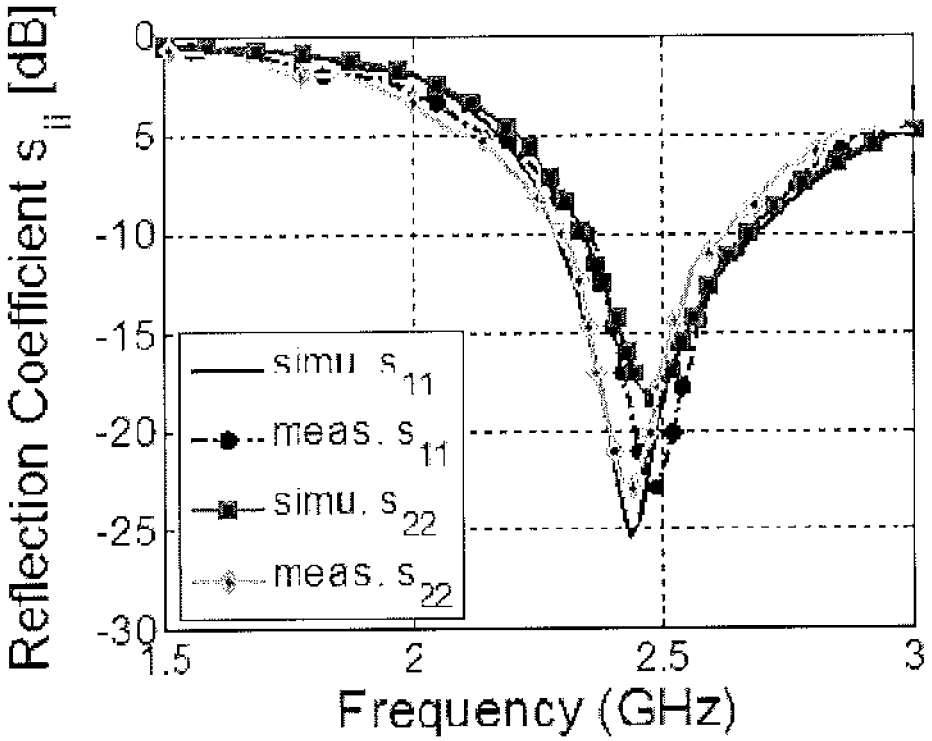
FIG. 4 is a plot showing simulated and measured reflection coefficients as a function of frequency for the antenna system according to one example.

FIG. 4 is a plot that shows simulated and measured reflection coefficients as a function of frequency for the PIFA based MIMO 104, 106 according to one example. Both antenna elements are resonating at center frequency of 2.45 GHz and good resonance is achieved in the entire band. Simulated and measured −10 dB bandwidth (BW) of 395 MHz is obtained (operating from 2.295 to 2.68 GHz).

Figure 5:
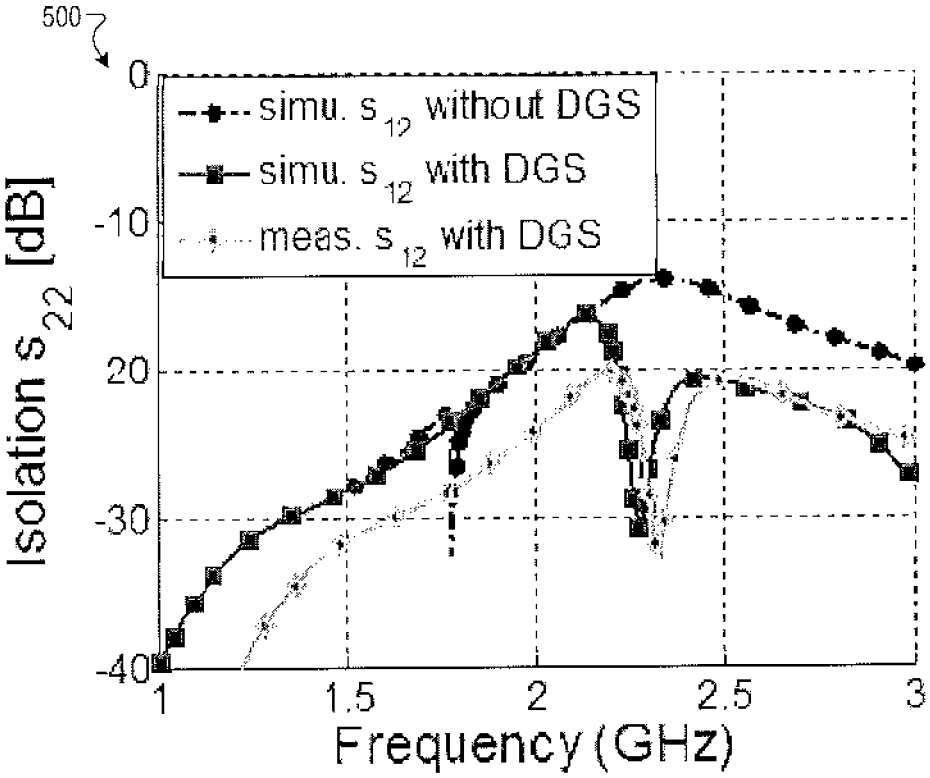
FIG. 5 is a plot showing simulated and measured isolation curves according to one example.

FIG. 5 is a plot showing simulated and measured isolation curves according to one example. The simulated and measured isolation curves between element 104 and element 106 with DGS slot and simulated without DGS slot are shown in plot 500. A minimum of 7 dB improvement is observed in isolation after introducing the DGS slots.

The annular slots on the GND plane are acting as DGS as well as utilized to get frequency reconfigurability in the MIMO antenna system 100. Varactor diodes 144, 150 are used to get the frequency agility in the design. Each varactor diode is modeled as a variable capacitor with values ranging between 2.38 pF to 9.91 pF. In the simulations, the capacitance values used are C1=2.38 pF, C2=12.61 pF, C3=4.11 pF, C4=7.36 pF and C5=9.918 pF. This resulted in antennas tuning between 1.76 to 2.3 GHz. The particular position of the varactor diode is selected such as the capacitance has the maximum effect on the frequency sweep of the design.

Figure 6:
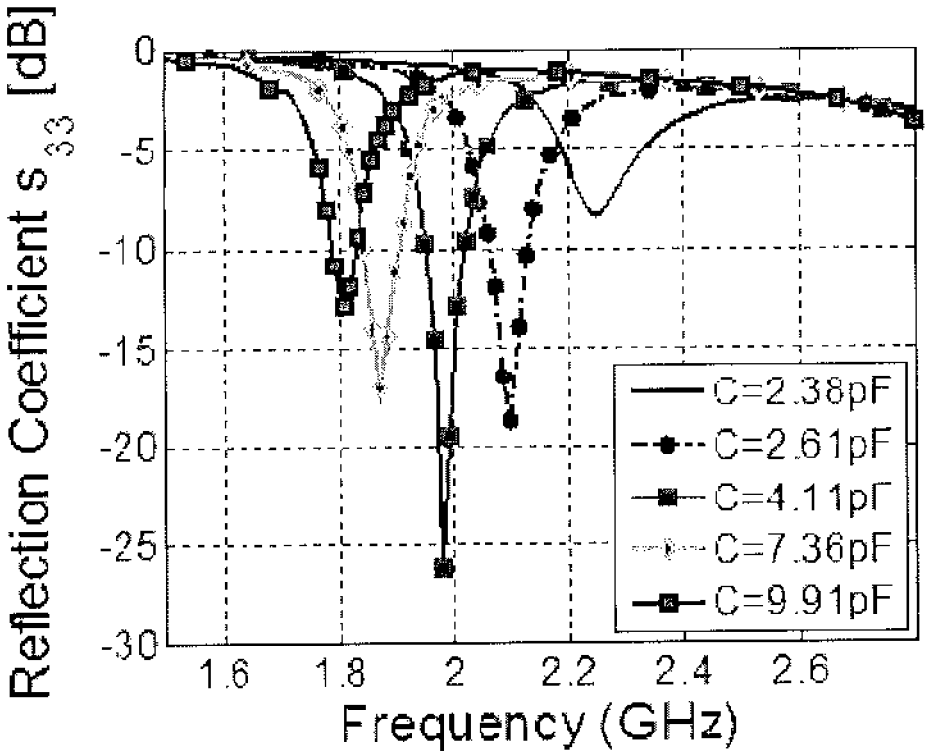
FIG. 6 is a plot showing simulated and measured reflection coefficients as a function of frequency for annular slots of the antenna system according to one example.
Figure 7:
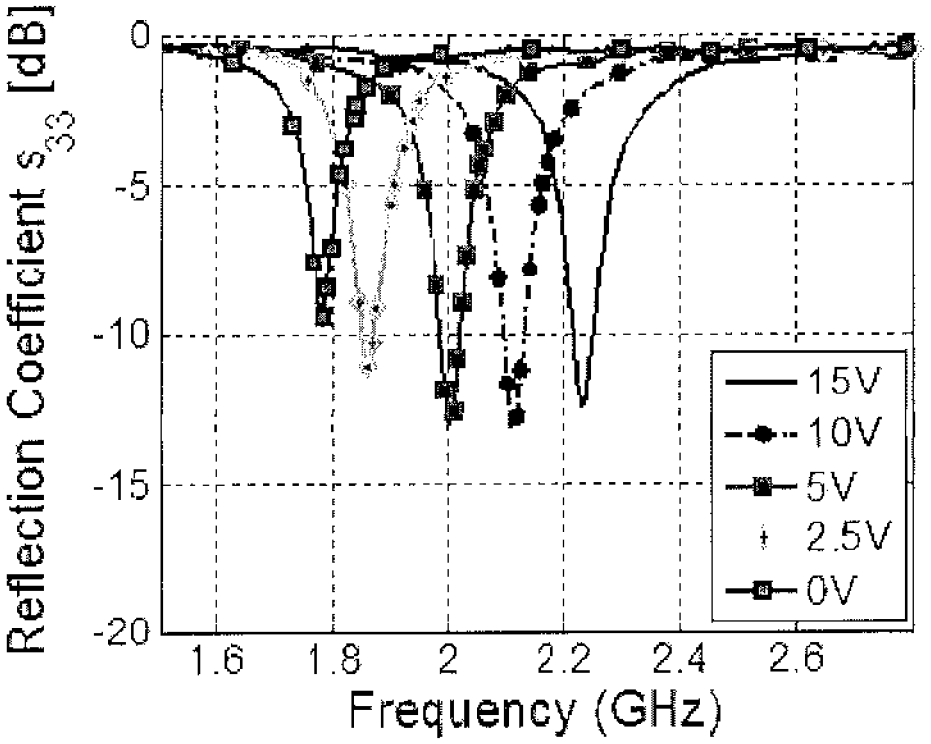
FIG. 7 is a plot showing simulated and measured reflection coefficients as a function of frequency for the annular slots of the antenna system according to one example.

The simulated and measured reflection coefficient curves for antenna 146, 148 are shown in FIG. 6. The minimum −6 dB operating bandwidth (BW) is 60 MHz. The resonance frequency bands are smoothly varied over a wide range, as shown by the curves. A reverse bias voltage is applied across the varactor diodes and the resonance curves are obtained by varying the reverse bias voltages (0 to 15 V) as shown in FIG. 7.

Figure 8:
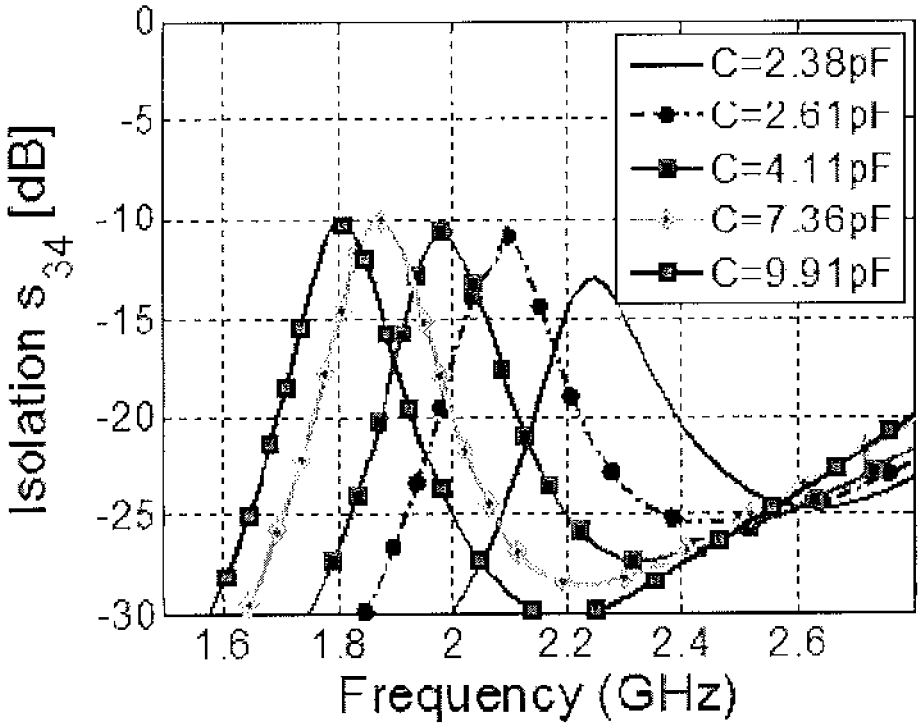
FIG. 8 is a plot showing simulated and measured isolation curves according to one example.
Figure 9:
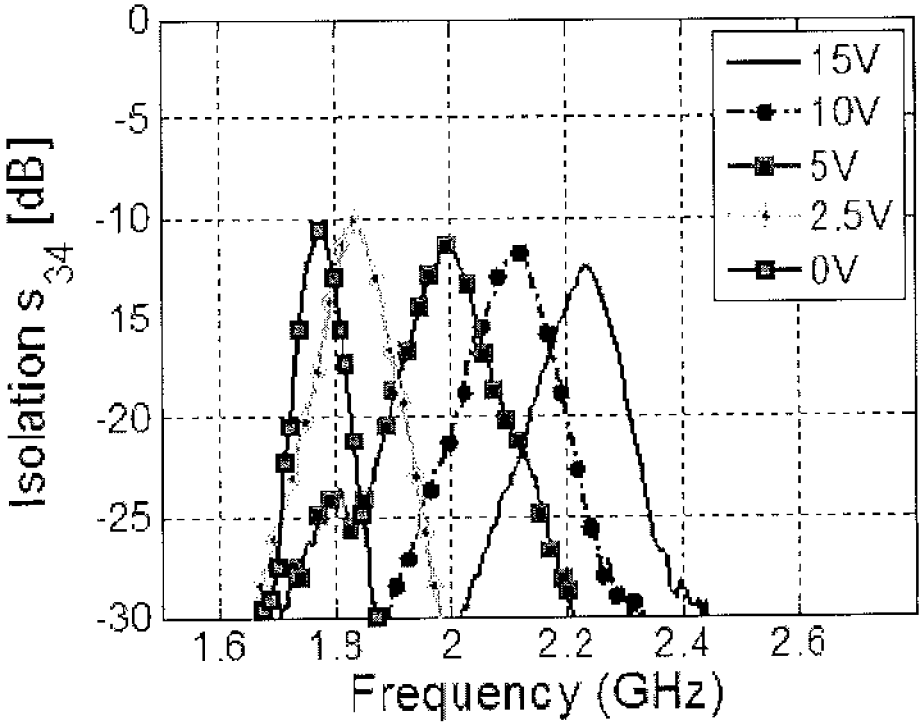
FIG. 9 is a plot showing simulated and measured isolation curves according to one example.

Mutual coupling between annular slots antenna 146 and 148 was analyzed. The simulated and measured isolation curves are shown in FIG. 8 and FIG. 9, respectively. For such closely spaced antennas, the isolation is better than 10 dB in the entire operating band (0.29 $\lambda_g$ spacing at 1.73 GHz). These values shows good isolation that is sufficient for MIMO operation in wireless communication devices.

Figure 10A:
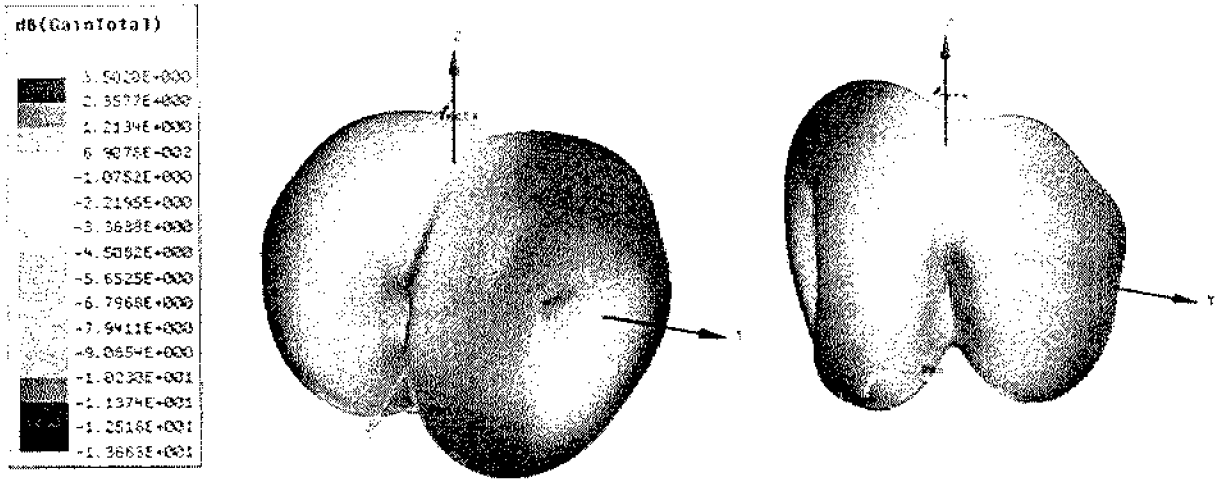
FIG. 10A is a three dimensional plot that shows the gain pattern of the antenna system at 2.45 GHz according to one example.
Figure 10B:
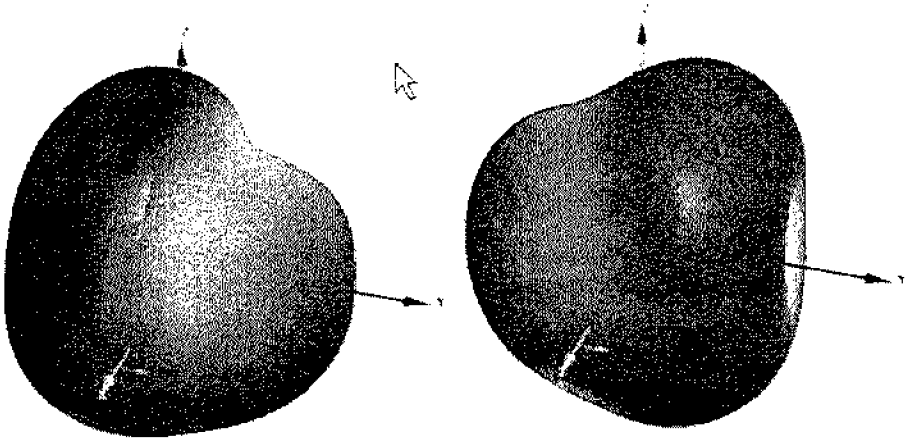
FIG. 10B is a three dimensional plot that shows the gain pattern of the antenna system at 2 GHz according to one example.

The 3D gain patterns of the proposed PIFA based MIMO antenna system 104, 106 is shown in FIG. 10A at 2.45 GHz. FIG. 10B shows the gain pattern for reconfigurable MIMO antenna system 146, 148 at 2.0 GHz.

Figure 11:
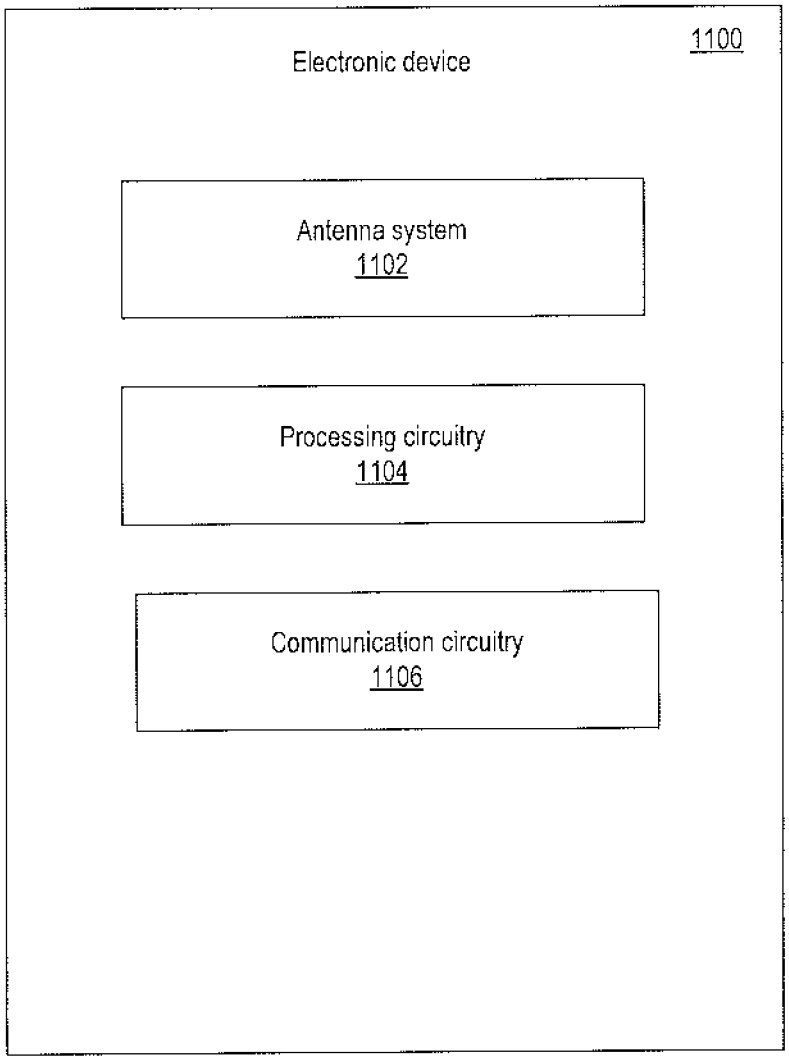
FIG. 11 is a simplified block diagram of an electronic device according to one example.

FIG. 11 is a simplified block diagram of an electronic device 1100 according to one example. The electronic device 1100 may include an antenna system 1102, processing circuitry 1104, and communication circuitry 1106. The processing circuitry 1104 may also include storage such as hard disk drive storage, nonvolatile memory (e.g., flash memory or other electrically-programmable-read-only memory configured to form a solid state drive), volatile memory (e.g., static or dynamic random access memory). The processing circuitry may be based on one or more microprocessors, microcontrollers, digital signal processors, application specific integrated circuits, and the like. The wireless communication circuitry 1106 may include radio-frequency transceiver circuitry for handling various radio-frequency communication bands. The wireless communication circuitry 1106 may also include cellular telephone transceiver circuitry for handling wireless communications in frequency ranges such as a low communications band from 700 to 960 MHz, a midband from 1500 to 2170 MHz, and a high band from 2170 or 2300 MHZ to 2700 MHz (e.g., a high band with a peak at 2400 MHz). The antenna system 1102 may be the antenna system described herein. As described previously herein, during the operation of the electronic device 1100, the processing circuitry 1104 may issue control signals to adjust voltage, capacitance values, or other parameters associated with tunable components of the antenna system thereby tuning the antenna system 1102 to cover desired communication bands.

A system which includes the features in the foregoing description provides numerous advantages to users. In particular, an integrated multiple-input-multiple-output (MIMO) antenna system is provided. The PIFA elements operates at the wireless local area network (WLAN) band while the annular slots act as an isolation enhancement structure for the PIFA elements. Further, the annular slots are tuned over a wide frequency bands from 1.73 GHz to 2.28 GHz with a minimum bandwidth of 60 MHz. The slots are made reconfigurable using varactor diodes by applying reverse bias voltage across their terminals. All the antenna elements are of small size, low profile and planar in structure and hence can easily be accommodated in wireless devices for second generation cognitive radio applications. The antenna system described herein is realized on a substrate area of 50×110 $mm^2$. The antenna system described herein supports several well-known wireless standards bands as would be understood by one of ordinary skill in the art.

Obviously, numerous modifications and variations are possible in light of the above teachings. It is therefore to be understood that within the scope of the appended claims, the invention may be practiced otherwise than as specifically described herein.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, defines, in part, the scope of the foregoing claim terminology such that no inventive subject matter is dedicated to the public.

The invention claimed is:

1. An antenna system, comprising:

a rectangular dielectric substrate having a top surface and a bottom surface;

a first planar inverted-F antenna (PIFA) radiating element and a second PIFA radiating element disposed on the top surface of the rectangular dielectric substrate, each of the first and second PIFA radiating elements having an F-head portion and an F-tail portion;

at least two defected ground structures (DGSs) disposed on the bottom surface of the rectangular dielectric substrate and configured to provide isolation between the first PIFA radiating element and the second PIFA radiating element, each of the at least two DGSs including a varactor diode; and a bias circuit corresponding to each of the at least two DGSs, wherein the first PIFA radiating element and the second PIFA radiating element are mirror images of each other, the first PIFA radiating element and the second PIFA radiating element are disposed along a first short edge and a second short edge of the rectangular dielectric substrate, respectively, the F-tails of the first PIFA radiating element and the second PIFA radiating element are parallel to the first short edge and the second short edge of the rectangular dielectric substrate, respectively, and the F-heads of the first PIFA radiating element and the second PIFA radiating element are parallel to a first long edge and a second long edge of the rectangular dielectric substrate, respectively, and face each other.

2. The antenna system of claim 1, wherein the bias circuit includes:

a first choke and a first resistor connected in series coupled between a negative terminal pad and a cathode of the varactor diode;

a second choke and a second resistor connected in series between a positive terminal pad and an anode of the varactor diode; and wherein the varactor diode has variable capacitance by connecting a variable DC voltage between the positive terminal pad and the negative terminal pad.

3. The antenna system of claim 1, further comprising:

a feed connector connected to the F-head portion of each PIFA radiating element.

4. The antenna system of claim 1, wherein each of the at least two DGSs is an annular slot.

5. The antenna system of claim 4, wherein the the first PIFA radiating element and the second PIFA radiating element are resonant at 2.45 GHz, and the annular slots cover a frequency band from 1.73 GHz to 2.28 GHz with a minimum bandwidth of 60 MHz.

6. The antenna system of claim 4, further comprising:

open-end microstrip transmission lines having a characteristic impedance of 50Ωcoupled to each of the annular slots.

7. The antenna system of claim 1, wherein the at least two DGSs are disposed along the first long edge of the rectangular dielectric substrate.

8. The antenna system of claim 1, wherein the F-tail portion of the first PIFA radiating element and the first short edge are spaced apart at a distance of 3.48 mm.

9. The antenna system of claim 8, wherein the F-head portion of the first PIFA radiating element includes a shorting arm and a feeder arm that are spaced apart at a distance of 7.4 mm.

10. The antenna system of claim 9, wherein the first PIFA radiating element has a radiator arm that is 11.8 mm in length.

11. An apparatus, comprising:

an antenna system including a rectangular dielectric substrate having a top surface and a bottom surface, a first planar inverted-F antenna (PIFA) radiating element and a second PIFA radiating element disposed on the top surface of the rectangular dielectric substrate, each of the first and second PIFA radiating elements having an F-head portion and an F-tail portion, at least two defected ground structure (DGS) disposed on the bottom surface of the rectangular dielectric substrate and configured to provide isolation between the first and the second PIFA radiating elements, each of the at least two DGSs including a varactor diode, and a bias circuit corresponding to each of the at least two DGSs, wherein the first PIFA radiating element and the second PIFA radiating element are mirror images of each other, the first PIFA radiating element and the second PIFA radiating element are disposed along a first short edge and a second short edge of the rectangular dielectric substrate, respectively, the F-tails of the first PIFA radiating element and the second PIFA radiating element are parallel to the first short edge and the second short edge of the rectangular dielectric substrate, respectively, and the F-heads of the first PIFA radiating element and the second PIFA radiating element are parallel to a first long edge and a second long edge of the rectangular dielectric substrate, respectively, and face each other; and wireless circuitry that uses the antenna system to handle signals in one or more communication bands.

12. The apparatus of claim 11, wherein each of the at least two DGSs is an annular slot.

13. The apparatus of claim 12, wherein the first and second PIFA radiating elements are resonant at 2.45 GHz, and the annular slots cover a frequency band from 1.73 GHz to 2.28 GHz with a minimum bandwidth of 60 MHz.

14. A method of configuring an antenna system, the method comprising:

forming a first planer inverted-F antenna (PIFA) and a second PIFA for operation at a desired frequency at a top surface of a rectangular dielectric substrate, each of the first and second PIFAs including an F-head portion and an F-tail portion;

forming at least two defected ground structures (DGSs) at a bottom surface of the rectangular dielectric substrate to provide isolation between the first and second PIFAs, each of the at least two DGSs including a varactor diode to reactively load the DGS;

forming a bias circuit for each the at least two DGSs: and controlling, using processing circuitry, a voltage to the varactor diode based on a desired resonant frequency, wherein the first PIFA and the second PIFA are mirror images of each other, the first PIFA and the second PIFA are disposed along a first short edge and a second short edge of the rectangular dielectric substrate, respectively, the F-tails of the first PIFA and the second PIFA are parallel to the first short edge and the second short edge of the rectangular dielectric substrate, respectively, and the F-heads of the first PIFA and the second PIFA are parallel to a first long edge and a second long edge of the rectangular dielectric substrate, respectively, and face each other.

15. The method of claim 14, wherein the bias circuit includes:

a first choke and a first resistor connected in series coupled between a negative terminal pad and a cathode of the varactor diode;

a second choke and a second resistor connected in series between a positive terminal pad and an anode of the varactor diode; and wherein the varactor diode has variable capacitance by connecting a variable DC voltage between the positive terminal pad and the negative terminal pad.

16. The method of claim 14, wherein each of the at least two DGSs is an annular slot.

17. The method of claim 16, wherein the first and second PIFAs are resonant at 2.45 GHz, and the annular slots cover a frequency band from 1.73 GHz to 2.28 GHz with a minimum bandwidth of 60 MHz.

18. The method of claim 14, wherein the F-tail portion of the first PIFA and the first short edge are spaced apart at a distance of 3.48 mm.

19. The method of claim 18, wherein the F-head portion of the first PIFA includes a shorting arm and a feeder arm that are spaced apart at a distance of 7.4 mm.

20. The method of claim 19, wherein the first PIFA has a radiator arm that is 11.8 mm in length.

* * * * *